US007911392B2

(12) United States Patent
Rao et al.

(10) Patent No.: US 7,911,392 B2
(45) Date of Patent: Mar. 22, 2011

(54) MULTIPLE FREQUENCY BAND ANTENNA ASSEMBLY FOR HANDHELD COMMUNICATION DEVICES

(75) Inventors: Qinjiang Rao, Waterloo (CA); Shirook M. Ali, Mississauga (CA); Dong Wang, Waterloo (CA)

(73) Assignee: Research in Motion Limited, Ontario (CA)

( * ) Notice: Subject to any disclaimer, the term of this patent is extended or adjusted under 35 U.S.C. 154(b) by 323 days.

(21) Appl. No.: 12/276,946

(22) Filed: Nov. 24, 2008

(65) Prior Publication Data

US 2010/0127936 A1 May 27, 2010

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702
See application file for complete search history.

(56) References Cited

U.S. PATENT DOCUMENTS

| | | | | |
|---|---|---|---|---|
| 5,547,100 | A | 8/1996 | Johnson | |
| 5,633,646 | A | 5/1997 | Strickland | |
| 6,593,887 | B2 | 7/2003 | Luk et al. | |
| 6,803,881 | B2 * | 10/2004 | Ishihara et al. | 343/700 MS |
| 6,950,071 | B2 | 9/2005 | Wen et al. | |
| 6,950,072 | B2 * | 9/2005 | Miyata et al. | 343/702 |
| 7,023,387 | B2 | 4/2006 | Wen et al. | |
| 7,038,627 | B2 | 5/2006 | Ikuta et al. | |
| 7,113,133 | B2 * | 9/2006 | Chen et al. | 343/700 MS |
| 7,283,097 | B2 | 10/2007 | Wen et al. | |
| 7,352,328 | B2 | 4/2008 | Moon et al. | |
| 7,369,089 | B2 | 5/2008 | Wen et al. | |
| 7,400,300 | B2 | 7/2008 | Qi et al. | |
| 7,403,165 | B2 | 7/2008 | Qi et al. | |
| 7,538,732 | B2 * | 5/2009 | Ishihara et al. | 343/702 |
| 2004/0085245 | A1 | 5/2004 | Miyata et al. | |
| 2006/0244665 | A1 * | 11/2006 | Tung | 343/702 |
| 2007/0109204 | A1 | 5/2007 | Phillips et al. | |
| 2008/0062058 | A1 | 3/2008 | Bishop | |
| 2008/0231530 | A1 | 9/2008 | Rao et al. | |
| 2008/0284661 | A1 | 11/2008 | He | |
| 2008/0287171 | A1 | 11/2008 | Qi et al. | |

FOREIGN PATENT DOCUMENTS

| | | | |
|---|---|---|---|
| EP | 1077505 | A2 | 2/2001 |
| EP | 1162688 | A1 | 12/2001 |
| JP | 2008167393 | A | 7/2008 |
| JP | 20080167393 | | 7/2008 |

(Continued)

OTHER PUBLICATIONS

European Search Report and Written Opinion for Application No. 09176843.2, mailed Feb. 16, 2010.

(Continued)

*Primary Examiner* — Tan Ho
(74) *Attorney, Agent, or Firm* — Quarles & Brady LLP

(57) ABSTRACT

An antenna assembly has a plurality of conductive elements to enable use in multiple frequency bands assigned for a mobile wireless communications. The antenna assembly has a six-sided support frame non-electrically conductive material which provides external surfaces on which specific conductive patterns are formed with the patterns on different surface being selectively connected together. The support frame is mounted on one major surface of a dielectric substrate that has an opposite major surface with a conductive layer that serves as ground plane. A portion of the opposite major surface, on which the conductive layer is not applied, forms one surface of the support frame.

23 Claims, 4 Drawing Sheets

FOREIGN PATENT DOCUMENTS

| | | | |
|---|---|---|---|
| WO | 2004015810 | A1 | 2/2004 |
| WO | 2008001169 | A2 | 1/2008 |
| WO | 2008049354 | A1 | 5/2008 |

OTHER PUBLICATIONS

Chuo, et al.; Investigations of Isolation Improvement Techniques for Multiple Input Multiple Output (MIMO) WLAN Portable Terminal Applications; Progress in Electromagnetics Research, PIER 85, 349-366, 2008.

Kim, et al.; High Isolation Internal Dual-Band Planar Inverted-F Antenna Diversity System with Band-Notched Slots for MIMO Terminals; Department of Electrical Engineering Korea Advanced Institute of Science and Technology (KAIST), 373-1 Guseong-Dong, Yuseong-Gu, Taejeon, 305-701, Korea.

Karaboikis, et al.; Compact Dual-Printed Inverted-F Antenna Diversity Systems for Portable Wireless Devices; IEEE Antennas and Wireless Propagation Letters, vol. 3, 2004.

Waldschmidt and Wiesbeck; Compact Wide-Band Multimode Antennas for MIMO and Diversity; IEEE Transactions on Antennas and Propagation; vol. 52, No. 8, Aug. 2004.

Svantesson; Correlation and Channel Capacity of MIMO Systems Employing Multimode Antennas; IEEE Transactions on Vehicular Technology, vol. 51, No. 6, Nov. 2002.

Forenza and Heath; Benefit of Pattern Diversity via Two-Element Array of Circular Patch Antennas in Indoor Clustered MIMO Channels; IEEE Transactions on Communications, vol. 54, No. 5, May 2006.

Vaughn; Two-Port Higher Mode Circular Microstrip Antennas; IEEE Transactions on Antennas and Propagation, vol. 36, No. 3, Mar. 1988.

* cited by examiner

MULTIPLE FREQUENCY BAND ANTENNA ASSEMBLY FOR HANDHELD COMMUNICATION DEVICES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

The present invention relates generally to antennas, and more specifically to multiple-band antennas that are particularly suited for use in wireless mobile communication devices, such as personal digital assistants, cellular telephones, and wireless two-way email communication devices.

Different types of wireless mobile communication devices, such as personal digital assistants, cellular telephones, and wireless two-way email communication apparatus are available. Many of these devices are intended to be easily carried on the person of a user, often fitting in a shirt or coat pocket.

The antenna configuration of a mobile communication device can significantly affect the overall size or footprint of the device. For example, cellular telephones typically have antenna structures that support communication in multiple operating frequency bands. Various types of antennas for mobile devices are used, such as helical, "inverted F", folded dipole, and retractable antenna structures, for example. Helical and retractable antennas are typically installed outside a mobile device, and inverted F antennas are usually located inside of a case or housing of a device. Generally, internal antennas are often used instead of external antennas for mobile communication devices for mechanical and ergonomic reasons. Internal antennas are protected by the case or housing of the mobile device and therefore tend to be more durable than external antennas. External antennas also may physically interfere with the surroundings of a mobile device and make a mobile device difficult to use, particularly in limited-space environments.

In some types of mobile communication devices, however, known internal structures and design techniques provide relatively poor communication signal radiation and reception, at least in certain operating positions. One of the biggest challenges for mobile device design is to ensure that the antenna operates effectively for various applications, which determines antenna position related to human support frame. Typical operating positions of a mobile device include, for example, a data input position, in which the mobile device is held in one or both hands, such as when a user is entering a telephone number or email message; a voice communication position, in which the mobile device may be held next to a user's head and a speaker and microphone are used to carry on a conversation; and a "set down" position, in which the mobile device is not in use by the user and is set down on a surface, placed in a holder, or held in or on some other storage apparatus. In these positions, parts of a user's support frame and other ambient objects can block the antenna and degrade its performance. Known internal antennas, that are embedded in the device housing, tend to perform relatively poorly, particularly when a mobile device is in a voice communication position. Although the mobile device is not actively being employed by the user when in the set down position, the antenna should still be functional at least receive communication signals.

The desire to maintain the configuration of the mobile communication device to a size that conveniently fits into a hand of the user, presents a challenge to antenna design. This creates a tradeoff between the antenna performance, which dictates a relatively larger size, and the available space for the antenna within the device.

The antenna size versus performance design issue becomes an even bigger challenge when the handheld communication device, which already must operate in multiple frequency bands, is required to accommodate the additional 700 MHz band. A conventional antenna for operation in that frequency range would entail a physical length of about a quarter of a wavelength, which at 700 MHz is approximately 10.7 cm. To accommodate an antenna with such size inside the handheld device is neither feasible nor practical. Moreover, having a single internal antenna that operates in the existing frequency bands, such as GSM/800/900/1800/1900 and UMTS 2100 in addition to the 700 MHz band, presents a design challenge.

DETAILED DESCRIPTION

An antenna assembly for a mobile wireless communication device has conductive elements on selected surfaces of a support frame, that can be a rectangular polyhedron. The support frame has a first surface, a second surface, a third surface, and a fourth surface all extending between a fifth surface and a sixth surface.

An F-shaped conductive member is located on the first surface and comprises a conductive stripe from which a first arm and a second arm project in a spaced-apart, parallel manner. The first arm is connected to a conductive loop on the fifth surface and the second arm is connected to a first conductive strip also on the fifth surface. The first conductive strip also is connected to a U-shaped conductive member that is located on the third surface.

A rectangular conductive patch is provided on the second surface and is connected to the conductive stripe of the F-shaped conductive member. A conductive remote strip, located on the second surface, is connected to the conductive loop. An L-shaped patch is on the sixth surface and is connected to the conductive remote strip. A second conductive strip, provided on the sixth surface, is connected to the U-shaped conductive member.

In one embodiment, the support frame is contiguous with a first major surface of a sheet of dielectric material that has an opposing second major surface with a conductive layer applied thereto that provides a ground plane. In this embodiment a portion of the second major surface, on which the conductive layer is not applied, forms the sixth surface of the support frame.

The present antenna assembly is specially adapted for use in mobile wireless communication devices, such as personal digital assistants, cellular telephones, and wireless two-way email communication devices, and for brevity those mobile wireless communication devices are referred to herein as mobile devices and individually as a mobile device. Furthermore, the present antenna assembly will be described in the specific context of a cellular telephone.

Figure 1:
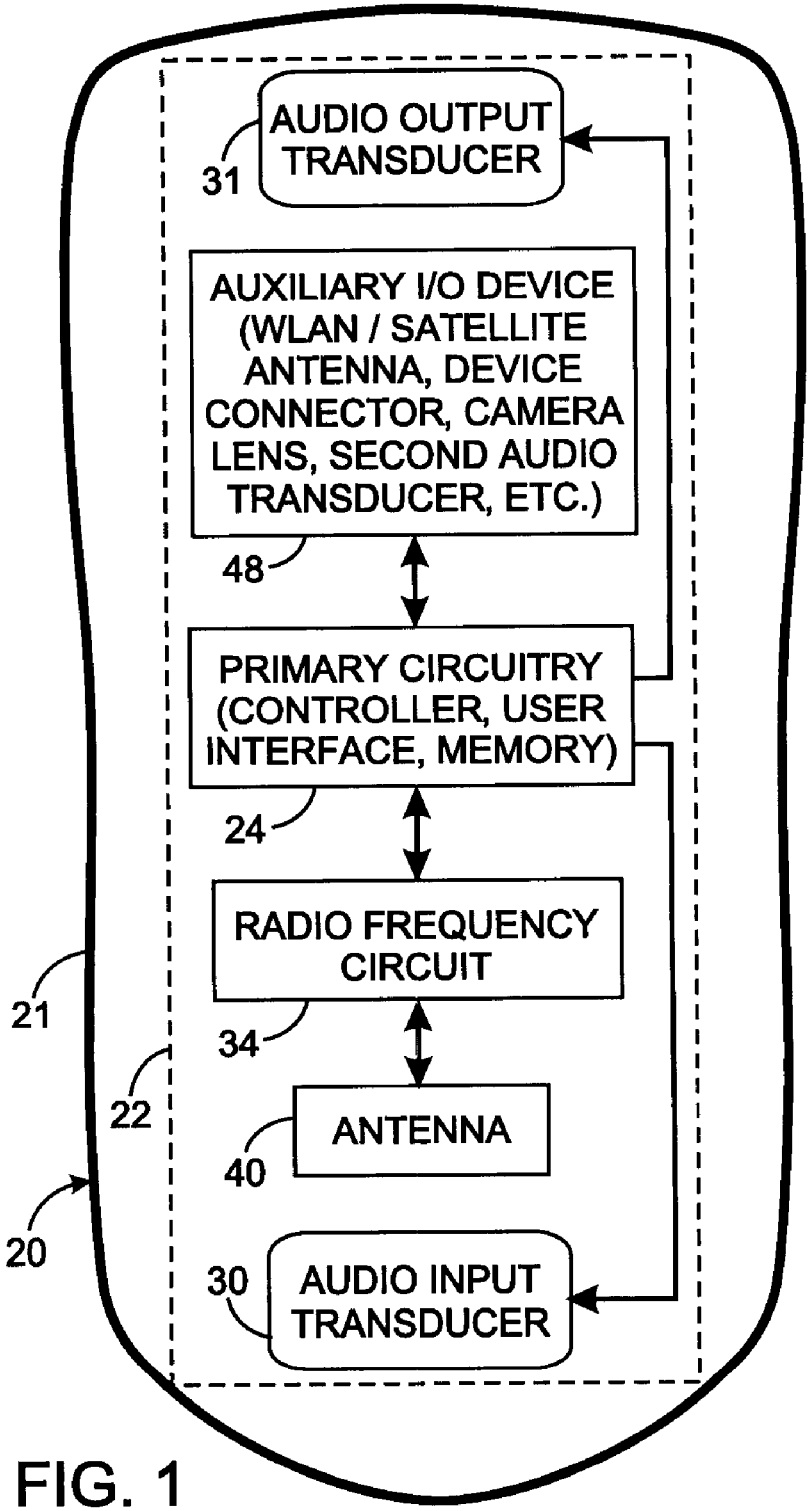
FIG. 1 is a schematic block diagram of a mobile wireless communication device.
Figure 2:
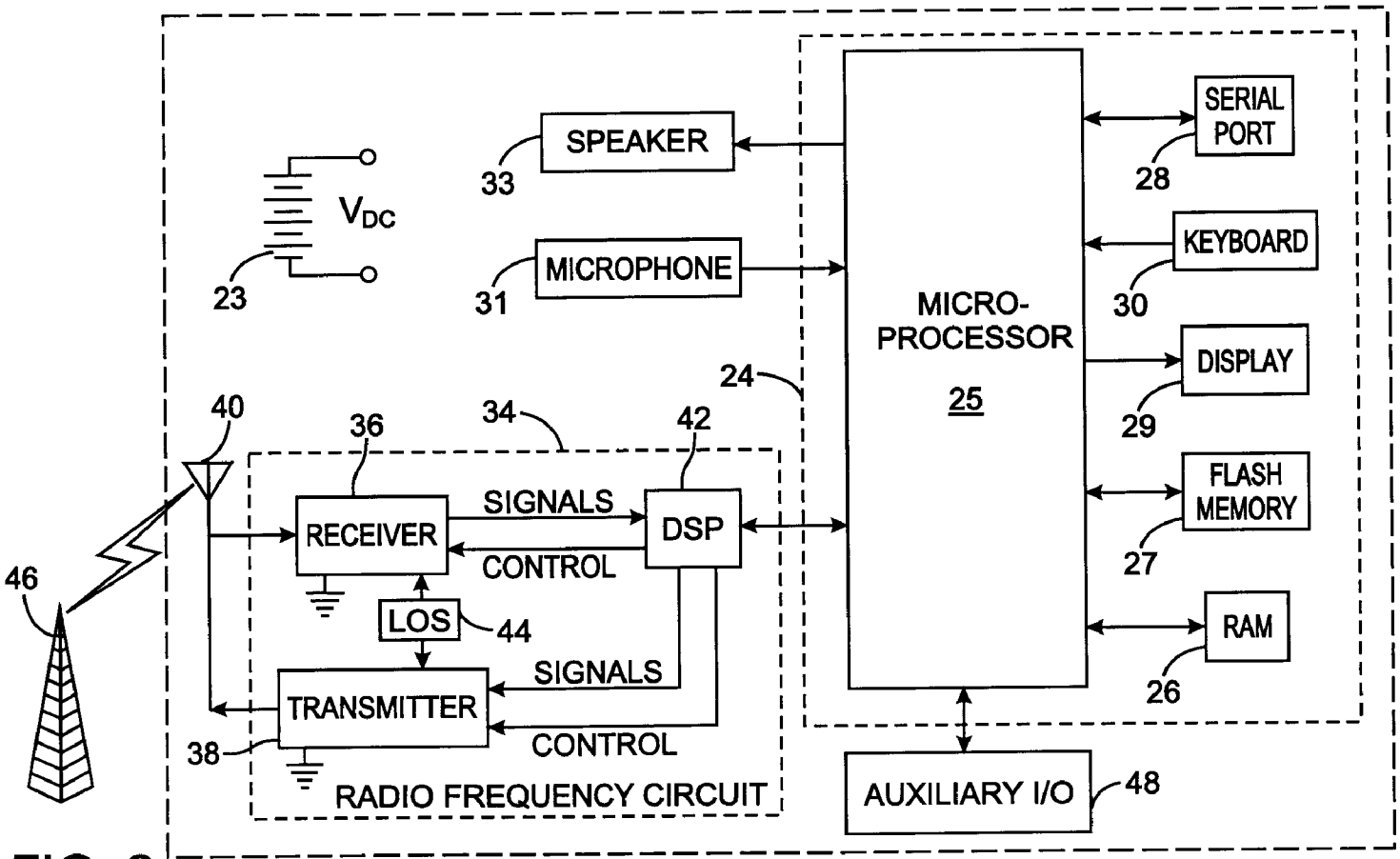
FIG. 2 is a schematic block diagram of the circuitry for the mobile wireless communication device.

Referring initially to FIGS. 1 and 2, a mobile device 20, such as a mobile cellular device, illustratively includes a housing 21 that may be a static housing, for example, as opposed to a flip or sliding housing which are used in many cellular telephones. Nevertheless, those and other housing configurations also may be used. A battery 23 is carried within the housing 21 for supplying power to the internal components.

The housing 21 contains a main dielectric substrate 22, such as a printed circuit board (PCB) substrate, for example, on which is mounted the primary circuitry 24 for mobile device 20. That primary circuitry 24, as shown in greater detail in FIG. 2, typically includes a microprocessor 25, memory that includes a random access memory (RAM) 26 and a flash memory 27 which provides non-volatile storage. A serial port 28 constitutes a mechanism by which external devices, such as a personal computer, can be connected to the mobile wireless communication device 20. A display 29 and a keyboard 30 provide a user interface for controlling the mobile wireless communication device 20.

An audio input device, such as a microphone 31, and an audio output device, such as a speaker 33, function as an audio interface to the user and are connected to the primary circuitry 24.

Communication functions are performed through a radio frequency circuit 34 which includes a wireless signal receiver 36 and a wireless signal transmitter 38 that are connected to a multiple-element antenna assembly 40. The antenna assembly 40 can be carried within the lower portion of the housing 21. The antenna assembly will be described in greater detail subsequently herein.

The radio frequency circuit 34 also includes a digital signal processor (DSP) 42 and local oscillators (LOs) 44. The specific design and implementation of the radio frequency circuit 34 is dependent upon the communication network in which the mobile device 20 is intended to operate. For example a device destined for use in North America may be designed to operate within the Mobitex™ mobile communication system or DataTAC™ mobile communication system, whereas a device intended for use in Europe may incorporate a General Packet Radio Service (GPRS) radio frequency circuit.

When required network registration or activation procedures have been completed, the mobile communication device 20 sends and receives signals over the communication network 46. Signals received by the multiple-element antenna from the communication network 46 are input to the receiver 36, which performs signal amplification, frequency down conversion, filtering, channel selection, and analog-to-digital conversion. Analog-to-digital conversion of the received signal allows the DSP 42 to perform more complex communication functions, such as demodulation and decoding. In a similar manner, signals to be transmitted are processed by the DSP 42 and sent to the transmitter 38 for digital-to-analog conversion, frequency up-conversion, filtering, amplification and transmission over the communication network 46 via the multiple-element antenna.

The mobile device 20 also may comprise one or auxiliary input/output devices 48, such as, for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position location capabilities, as will be appreciated by those skilled in the art. Other examples of auxiliary I/O devices 48 include a second audio output transducer (e.g., a speaker for speakerphone operation), and a camera lens for providing digital camera capabilities, an electrical device connector (e.g., USB, headphone, secure digital (SD) or memory card, etc.).

Structures for the antenna assembly 40 described herein are sized and shaped to tune the antenna for operation in multiple frequency bands. In an embodiment described in detail below, the multiple-band antenna includes structures that are primarily associated with different operating frequency bands thereby enabling the multiple-band antenna to function as the antenna in a multi-band mobile device. For example, a multiple-band antenna assembly 40 is adapted for operation at the Global System for Mobile communications (GSM) 900 MHz frequency band and the Digital Cellular System (DCS) frequency band. Those skilled in the art will appreciate that the GSM-900 band includes a 880-915 MHz transmit sub-band and a 925-960 MHz receive sub-band. The DCS frequency band similarly includes a transmit sub-band in the 1710-1785 MHz range and a receive sub-band in the 1805-1880 MHz range. The antenna assembly 40 also functions in the Universal Mobile Telecommunications System (UMTS) 2100 MHz bands and in the 700 MHz frequency band. It will also be appreciated by those skilled in the art that these frequency bands are for illustrative purposes only and the basic concepts of the present antenna assembly can be applied to operate in other pairs of frequency bands.

Figure 3:
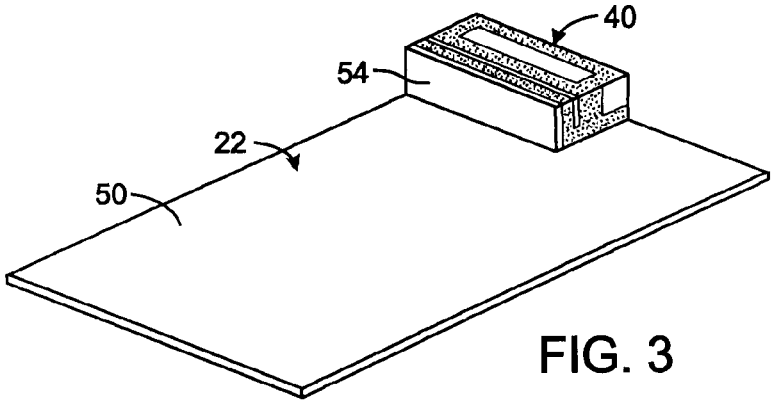
FIG. 3 is a perspective view from above a dielectric substrate on which an antenna assembly of the communication device is mounted.
Figure 4:
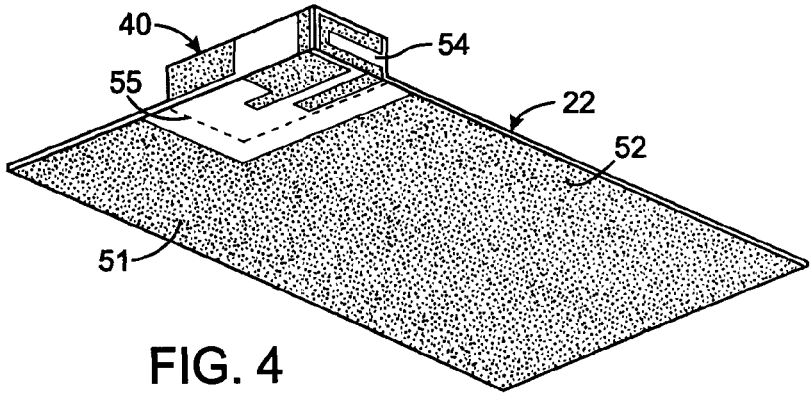
FIG. 4 is a perspective view from below the dielectric substrate.

With reference to FIGS. 3 and 4, the electrically non-conductive substrate 22 on which the electronic circuits for the mobile device are formed comprises a flat sheet of dielectric material of a type conventionally used for printed circuit boards. Alternatively, the substrate 22 may be contoured to fit the interior shape of the mobile device housing 21. The dielectric substrate 22 has a first major surface 50 with one or more layers of patterns of conductive material, such as copper, to which circuit components are connected by soldering, for example. The antenna assembly 40 can be mounted at one corner of the dielectric substrate 22 projecting away from the first major surface 50. An opposite second major surface 51 of the substrate 22 has a layer 52 of conductive material, such as copper, applied thereto. The conductive layer 52 extends over the majority of the second major surface 51, except for a portion adjacent the antenna assembly 40. The conductive layer 52 forms a ground plane for the mobile device 20.

Figure 8:
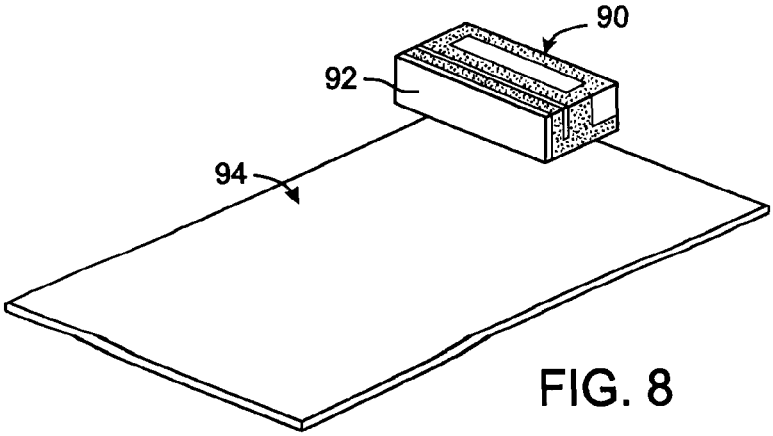
FIG. 8 is a perspective view of an embodiment of the antenna mounted on a support frame that is separate from the dielectric substrate.

The multi-frequency antenna assembly 40 comprises specific electrically conductive patterns on surfaces of a rectangular polyhedron which forms the support frame 54 of the antenna assembly. In one version, the support frame 54 is constructed of a dielectric material, such as FR-4 laminate which is a continuous glass-woven fabric impregnated with an epoxy resin binder. The rectangular polyhedron support frame 54 may be 30 mm by 15 mm by 9 mm high. In one embodiment, the antenna support frame 54 is hollow being fabricated of five panels of dielectric material that are 1.5 mm thick and secured together at their edges and to the first major surface 50 of the dielectric substrate using appropriate means, such as an adhesive. Alternatively, a solid support frame for the antenna assembly can be utilized. Regardless of the specific construction, the antenna support frame 54 is considered as having six surfaces, including a portion of the second major surface 51 of the dielectric substrate 22 which is directly beneath the remainder of the support frame 54 as seen in FIG. 4 and demarked by dashed line 55. As a further alternative, the support frame 54 can be formed by six panels secured together to form a separate rectangular polyhedron that is spaced from the dielectric substrate 22, as seen in FIG. 8.

Figure 5:
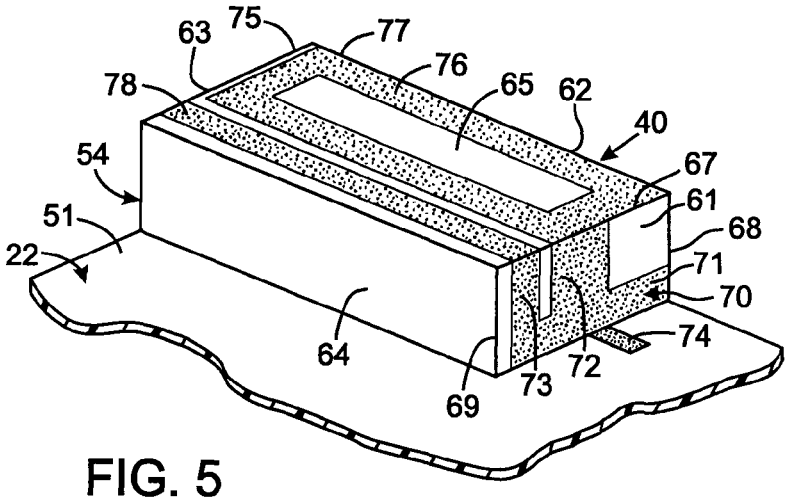
FIG. 5 is an enlarged perspective view from a first angle, showing three surfaces of a support frame on which the antenna is formed.
Figure 6:
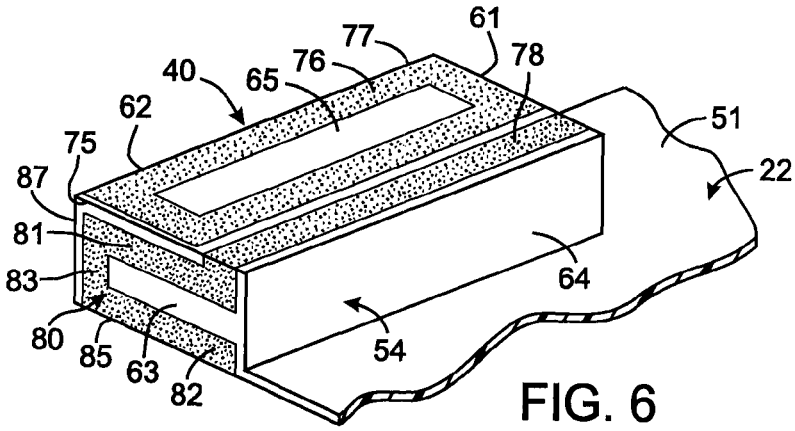
FIG. 6 is an enlarged perspective view from a second first angle showing the details of three surfaces of the support frame.
Figure 7:
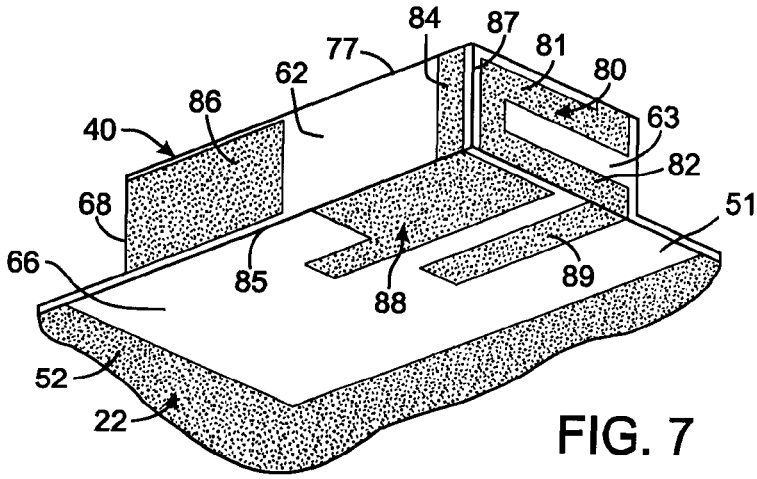
FIG. 7 is an enlarged perspective view from beneath the dielectric substrate and showing three surfaces of the support frame.

Referring to FIGS. 5, 6 and 7, the rectangular polyhedron support frame 54 has a first surface 61, a second surface 62, a third surface 63 and a fourth surface 64 forming four sides of the support frame. A fifth surface 65 forms the top surface and a sixth surface 66, comprising a portion of the second major surface 51 of the dielectric substrate 22, forms a bottom of the antenna support frame. The first, second, third and fourth surfaces 61-64 extend between the fifth and sixth surfaces 65 and 66. The antenna support frame 54 is located at one corner of the dielectric substrate 22 with the second and third surfaces 62 and 63 of the support frame flush with and incorporating a portion of two edges of that substrate. The first surface and fourth surfaces 61 and 64 abut and project away from portions of the first major surface 50 of the dielectric substrate 22.

The antenna assembly 40 comprises electrically conductive material applied to different surfaces of the support frame 54 in selected patterns to form segments of the antenna assembly 40. There is no conductive pattern on the fourth surface of the support frame 54. As shown in FIG. 5, an F-shaped member 70 is formed on the first surface 61 and has a first conductive stripe 71 extending from an edge at which the first surface meets the second surface along the portion of the first surface that is immediately adjacent to the dielectric substrate 22. Electrical connection to the antenna assembly 40 is made at a conductive area 74 on the first major surface 50 of the dielectric substrate 22 and connected to a middle section of the first conductive stripe 71. The antenna assembly 40 is excited by a signal applied from the transmitter 38 between the ground plane conductive layer 52 and the conductive area 74. The F-shaped member 70 further comprises first and second spaced-apart, parallel arms 72 and 73 attached to the first conductive stripe 71 and projecting upward therefrom and away from dielectric substrate 22. The first and second arms 72 and 73 extend to the edge 67 of the first surface 61 that abuts the fifth surface 65. The first arm 72 is spaced from the edge 68 at which the first surface 61 adjoins the second surface 62. The second arm 73 and the first conductive stripe 71 are spaced from the edge 69 at which the first surface 61 abuts the fourth surface 64.

The first arm 72 of the F-shaped member 70 is connected, at the edge 67 between the first and fifth surfaces 61 and 65, to a corner of a conductive loop 76 on the fifth surface 65. The conductive loop 76 extends to an opposite edge 75 where the fifth surface 65 abuts the third surface 63, and extends along another edge 77 in common with the fifth and second surfaces 65 and 62. The conductive loop 76 is rectangular, however other loop shapes can be employed. The conductive loop 76 extends across approximately two-thirds of the area of the fifth surface 65. A first straight conductive strip 78 also is located on the fifth surface 65 extending between the edge 67 shared with the first surface 61 to the opposite edge 75 shared with the third surface 63. The first conductive strip 78 has one end that is connected at edge 67 to the second arm 73 of the F-shaped member 70.

The opposite end of the first conductive strip 78 extends around edge 75 onto the third surface 63 where, as seen in FIG. 6, it is connected to one end of a U-shaped member 80. Specifically the first conductive strip 78 connects to a first end of a first leg 81 of the U-shaped member 80, which first leg is parallel to and spaced from a second leg 82 that extends along the bottom edge 85 of the third surface 63 that abuts the first major surface 50 of the dielectric substrate 22. A cross leg 83 connects a second end of the first leg 81 to an adjacent end of the second leg 82. The cross leg 83 is slightly spaced from the edge 87 at which the third surface 63 abuts the second surface 62. The U-shaped member 80 is oriented as though it is lying on its side against the bottom edge 85 of the third surface 63 that is contiguous with the dielectric substrate 22.

With particular reference to FIGS. 6 and 7, a first patch 86 is located on the second surface 62 of the support frame 54 and has a rectangular shape abutting the edges 68 and 77 where the second surface interfaces with the first and fifth surfaces 61 and 65, respectively. The first patch 86 is connected to the end of the first conductive stripe 71 of the F-shaped member 70 on the first surface 61. A conductive remote strip 84 also is located on the second surface 62 and extends between the edges 77 and 85 which the second surface respectively shares with the fifth and sixth surfaces 65 and 66. The conductive remote strip 84 is parallel to and spaced from the edge 87 at which the second surface 62 abuts the third surface 63. One end of the conductive remote strip is connected to the loop 76 on the fifth surface 65.

With particular reference to FIG. 7, the other end of the conductive remote strip 84 is connected to an L-shaped patch 88 on the sixth surface 66 of the antenna support frame 54. That interconnection is at one end of a leg of the L-shaped patch 88 with another leg near the center of the support frame 54 projecting parallel to the edge 85 between the second and sixth surfaces 62 and 66. A straight second conductive strip 89 also is located on the sixth surface 66 on the remote side of the L-shaped patch 88 from the second surface 62 and parallel to the second surface 62. The second conductive strip 89 is connected to the free end of the second leg 82 of the U-shaped member 80 on the third surface 63. The L-shaped patch 88 and the second conductive strip 89 on the sixth surface of the antenna support frame 54 are spaced from the ground plane conductive layer 52. The rectangular first patch 86 and the L-shaped patch 88 provide impedance matching of the antenna assembly 40 with the impedance of a radio frequency circuit 34. Specifically the first patch 86 provides impedance matching at the lower frequency bands, while the L-shaped patch 88 performs impedance matching at the higher frequencies.

The conductive components on the antenna support frame 54 can be formed by applying a layer of conductive material, such as copper, to the entirety of the respective surface of the support frame 54 and then using a photolithographic process to etch away the conductive material from areas of that surface where a conductive part is not desired.

The various electrically conductive antenna components combine to form elements of the antenna assembly 40. A first antenna element comprises the first arm 72 of the F-shaped member 70, the conductive loop 76, and the conductive remote strip 84. The first antenna element resonates in the 800 MHz and 900 MHz frequency bands. A second antenna element comprises the second arm 73, the first conductive strip 78, the U-shaped conductive member 80, and the second conductive strip 89. A second antenna element is longer that the first antenna element and resonates in the 700 MHz frequency band. The wrapping of the first and second antenna elements in close proximity to each other widens the bandwidth of the antenna assembly. Sections of the two antenna element resonate at higher frequencies in the 1800 MHz, 1900 MHz and 2100 MHz frequency bands.

FIG. 8 illustrates a second antenna assembly 90 that is formed on a second support frame 92 of dielectric material. The second support frame 92 is a six-sided rectangular polyhedron that is the same as the first support frame 54 described previously, except that the second support frame 92 is separate from the dielectric substrate 94 on which the components of the mobile device are mounted. The second antenna assembly 90 comprises the same configuration of conductive patterns on each of its surfaces as on the surfaces of the first support frame 54, however the sixth surface is not also a surface of the dielectric substrate 94.

The foregoing description was primarily directed to a certain embodiments of the antenna. Although some attention was given to various alternatives, it is anticipated that one skilled in the art will likely realize additional alternatives that are now apparent from the disclosure of these embodiments. Accordingly, the scope of the coverage should be determined from the following claims and not limited by the above disclosure.

The invention claimed is:

1. An antenna assembly for a mobile wireless communication device comprising:

a support frame having a first surface, a second surface, a third surface and a fourth surface all extending between a fifth surface and a sixth surface;

a conductive stripe on the first surface;

a first conductive element having conductive sections on the first and fifth surfaces of the support frame and resonating in a first frequency band; and a second conductive element having conductive sections on the first, third, fifth and sixth surfaces of the support frame and resonating in a second frequency band.

2. The antenna assembly as recited in claim 1 wherein the first and conductive elements interact to resonate at wider frequency bands and either element alone.

3. The antenna assembly as recited in claim 1 wherein the first conductive element comprises a first arm connected to the conductive stripe, a conductive loop on the fifth surface and connected to the first arm; and the second conductive element comprises a second arm connected to the conductive stripe, a first conductive strip on the fifth surface and connected to the second arm, a conductive member on the third surface and connected to the first conductive strip, and a second conductive strip on the sixth surface and connected to the conductive member.

4. The antenna assembly as recited in claim 3 further comprising a conductive remote strip on the second surface and connected to the conductive loop.

5. The antenna assembly as recited in claim 4 further comprising an L-shaped patch on the sixth surface and connected to the conductive remote strip.

6. The antenna assembly as recited in claim 5 wherein one end of the conductive remote strip is connected to the conductive loop and another end of the conductive remote strip is connected to an end of one leg of the L-shaped patch.

7. The antenna assembly as recited in claim 6 wherein another leg of the L-shaped patch extends parallel to an edge of the support frame at which the second surface meets the sixth surface.

8. The antenna assembly as recited in claim 3 wherein the conductive member on the third surface is U-shaped.

9. The antenna assembly as recited in claim 8 wherein the U-shaped conductive member has a first leg and a second leg, each having one end connected to a cross leg, wherein another end of the first leg is connected to the first conductive strip and another end of the second leg is connected to the second conductive strip.

10. The antenna assembly as recited in claim 1 further comprising a conductive patch on the second surface and connected to the first and second conductive elements.

11. The antenna assembly as recited in claim 1 wherein the support frame is formed of electrically non-conductive material.

12. The antenna assembly as recited in claim 1 wherein the support frame is hollow.

13. The antenna assembly as recited in claim 1 wherein the fourth surface is void of any conductive material.

14. The antenna assembly as recited in claim 1 further comprising a conductive element spaced from the support frame and forming a ground plane.

15. The antenna assembly as recited in claim 1 further comprising a sheet of electrically non-conductive material having a first major surface abutting the support frame, and having a second major surface, a first portion of which has a layer of conductive material.

16. The antenna assembly as recited in claim 1 further comprising further comprising a terminal for coupling to a radio frequency circuit, wherein the terminal is connected to the first and second conductive elements.

17. An antenna assembly for a mobile wireless communication device comprising:

a non-conductive support frame having a first surface, a second surface, a third surface and a fourth surface all extending between a fifth surface and a sixth surface;

an F-shaped conductive member on the first surface and comprising a conductive stripe from which a first arm and a second arm project in a spaced-apart, parallel manner;

a conductive loop on the fifth surface and connected to the first arm;

a first conductive strip on the fifth surface and connected to the second arm;

a U-shaped conductive member on the third surface and connected to the first conductive strip;

a conductive remote strip on the second surface and connected to the conductive loop; and a second conductive strip on the sixth surface and connected to the U-shaped conductive member.

18. The antenna assembly as recited in claim 17 further comprising a rectangular conductive patch on the second surface and connected to the conductive stripe of the F-shaped conductive member.

19. The antenna assembly as recited in claim 17 further comprising an L-shaped patch on the sixth surface and connected to the conductive remote strip.

20. The antenna assembly as recited in claim 19 wherein one end of the conductive remote strip is connected to the conductive loop and another end of the conductive remote strip is connected to an end of one leg of the L-shaped patch.

21. The antenna assembly as recited in claim 17 wherein the U-shaped conductive member has a first leg and a second leg, each having one end connected to a cross leg, wherein another end of the first leg is connected to the first conductive strip and another end of the second leg is connected to the second conductive strip.

22. The antenna assembly as recited in claim 17 further comprising further comprising a terminal for coupling to a radio frequency circuit, wherein the terminal is connected to the conductive stripe of the F-shaped conductive member.

23. The antenna assembly as recited in claim 17 further comprising a conductive element spaced from the support frame and forming a ground plane.

* * * * *